United States Patent [19]

Marker

[11] 3,931,980

[45] Jan. 13, 1976

[54] SAFETY SKI BINDING SYSTEM

[76] Inventor: Hannes Marker, Garmisch-Partenkirchen, Germany

[22] Filed: June 28, 1973

[21] Appl. No.: 374,498

Related U.S. Application Data

[62] Division of Ser. No. 142,144, May 11, 1971, Pat. No. 3,785,668.

[30] Foreign Application Priority Data

May 12, 1970 Germany ..... 2023169
Nov. 11, 1970 Germany ..... 2055499

[52] U.S. Cl. ..... 280/11.35 R
[51] Int. Cl.[2] ..... A03C 9/08
[58] Field of Search ..... 280/11.35 D, 11.35 K, 11.35 C, 280/11.35 Y, 11.35 T, 11.35 H, 11.35 R

[56] References Cited

UNITED STATES PATENTS

| | | | |
|---|---|---|---|
| 3,359,009 | 12/1967 | Hinterholzer | 280/11.35 K |
| 3,672,695 | 6/1972 | Baukhage | 280/11.35 K |
| 3,727,932 | 5/1973 | Druss et al. | 280/11.35 K |
| 3,785,668 | 1/1974 | Marker | 280/11.35 R |

FOREIGN PATENTS OR APPLICATIONS

| | | | |
|---|---|---|---|
| 412,672 | 11/1966 | Switzerland | 280/11.35 K |
| 1,077,640 | 5/1954 | France | 280/11.35 K |

*Primary Examiner*—Leo Friaglia
*Assistant Examiner*—Milton L. Smith
*Attorney, Agent, or Firm*—Fleit & Jacobson

[57] ABSTRACT

A safety ski binding system comprises a heel-hold device and an abutment mounted on the ski as well as the sole of the skiing boot. The heel-holding device normally forces the sole of the boot against the abutment and in response to a vertically and/or horizontally directed overload releases the skiing boot. The abutment consists of a disc, which is secured to the ski to be at least approximately coaxial to the tibia and when the skiing boot is applied extends into a corresponding recess in the sole of the boot.

4 Claims, 18 Drawing Figures

SAFETY SKI BINDING SYSTEM

This application is a division of application Ser. No. 142,144 filed May 11, 1971, now U.S. Pat. No. 3,785,668 issued Jan. 15, 1974.

The present invention relates to a ski binding system in which functional parts comprise a heel-holding device and an abutment mounted on the ski as well as the sole of the skiing boot, and in which the heel-holding device normally forces the sole of the boot against the abutment and in response to a vertically and/or horizontally directed overload releases the skiing boot.

The known commercially available safety ski bindings generally comprise separately located releasing devices for a release in response to forward and twisting falls, respectively. Other safety ski bindings are known which comprise only a backing member in front of the skiing boot and a releasing device responsive to forward and twisting falls and disposed behind the skiing boot. Each of these two types of bindings has advantages and disadvantages compared to the other.

The most important disadvantage of the bindings of the first type is the considerable influence of the varying friction between the skiing boot and the ski. The most important disadvantage of the bindings of the second type resides in that the holding forces required in modern skiing cannot be provided if the margin of safety which is also required is provided for. A disadvantage which is common to bindings of both types resides in that the skiing boot may become seized between the two gripping points, which are spaced a relatively large distance apart, when the ski is deflected, e.g., as it moves through a depression. Under this condition, particularly a release of the binding in response to a dangerous twisting stress is obstructed or even prevented so that in spite of a correctly adjusted safety ski binding a fall of the skier may result in a typical skiing injury.

Whereas it has been possible most recently much to decrease the undesirable influence of the friction in the bindings of the first type by the use of means which reduce the friction, such bindings involve a higher structural expenditure and higher manufacturing costs than the bindings of the second type and cannot be handled in such a fast and simple manner to adjust the forces required for a release.

It is an object of the present invention to provide a safety ski binding system which combines to a large extent the advantages of the bindings of the known types but is free of their disadvantages.

In a safety ski binding system, in which functional parts comprise a heel-holding device and an abutment mounted on the ski as well as the sole of the skiing boot, and in which the heel-holding device normally forces the sole of the boot against the abutment and in response to a vertically and/or horizontally directed overload releases the skiing boot, this object is accomplished according to the invention in that the abutment consists of a disc, which is secured to the ski to be at least approximately coaxial to the tibia and which when the skiing boot is applied extends into a corresponding recess in the sole of the boot. As a result, the distance between the points where the skiing boot is gripped is maintained so that the skiing boot will not be seized when the ski is deflected, and the axis of rotation of the skiing boot on the ski for a pivotal movement in a plane which is parallel to the ski is exactly located by very simple structural means. Besides, any steering forces exerted by the skier's leg act on the ski virtually directly and by-pass the safety elements.

To facilitate the application of the skiing boot, particularly after a safety release, it will be suitable if the disc has a wedge-shaped top portion having wedge surfaces which extend in the longitudinal direction of the ski.

In a development of the invention it has proved desirable to provide in the sole of the boot a horizontal hole, which extends at least approximately transversely to the longitudinal direction of the sole, and to arrange the recess which receives the disc so as to open into said hole. Any snow which has become fixed in the recess can then be laterally forced out of the sole of the boot when the latter is applied to the disc. To facilitate the forcing out of the snow, it has proved desirable to provide a wedge-shaped nose, which is disposed opposite to the recess and extends into the hole and has a ridge which extends in the longitudinal direction of the boot.

To increase the durability of the system, the recess in the sole of the boot may be lined with a shell of wear-resisting material, such as metal.

In another development of the invention, a functional part of the skiing boot may consist of a separate soleplate, which in known manner is connected to the skiing boot to be only arbitrarily detachable therefrom and is formed with the recess for the abutment. In this case the advantages of the invention may be utilized in conjunction with an old or conventional skiing boot. The separate soleplate may suitably consist of a metal plate in order to enable also the use of skiing boots which have a relatively soft sole.

In another development of the invention, a device which is displaceable in the longitudinal direction of the ski against a spring bias and which engages the top of the toe portion of the sole may be mounted on the ski so that a second means for holding down the ski is provided in addition to the heel holding device. To avoid a loading of the safety ski binding system with additional, unnecessary friction forces during the release, it has been found desirable to provide the arrangement with two mushroom-shaped rollers, which are rotatably mounted on a longitudinally displaceable carrier plate and are kinematically coupled to each other by an endless belt and with their caps are suitably conical on the underside so that the skiing boot will be released also during a rearward fall of the skier.

To prevent damage to or destruction of the functional surfaces when the person wearing the boot walks on dirty ground or over rubble so that the safety function of the binding may be adversely affected whereas this may not be detected in time by the user of the binding, particularly if he is not technically skilled, the disc constitutes preferably a member of a detent mechanism of the heel-holding device.

This concept may be realized in that the disc comprises a clamp abutment, which interlocks with a detent pin of the heel-holding device, and a radially displaceable, spring-loaded clamp jaw. The detent pin may be secured to the sole of the boot at the top of the recess therein and may depend therefrom. In this arrangement, the detent pin is well protected in the recess in the sole of the boot. A perfect protection of the detent pin is ensured in another embodiment, in which the detent pin is provided on a hood for the disc, which hood extends into the recess in the sole of the boot and is secured to the boot by locking means which can be only arbitrarily unlocked. In this arrangement, the safety elements are disposed inside the hood when the binding is not used and during normal skiing.

In another embodiment, the disc carries an upwardly extending detent pin, which is normally locked by at least one resilient clamp member of a hood for the disc, which hood extends into the recess in the sole of the boot and is secured to the boot by locking means which can be only arbitrarily unlocked.

The locking means consist preferably of at least one coupling pin and at least one pivoted locking arm, which is formed by one arm of a two-armed lever, the second arm of which serves as an unlocking member and which can be pivotally moved against a spring bias from its locking position to an unlocking position. The coupling pin or pins may be provided on the hood and the pivoted locking arm or arms may be provided on the skiing boot. Desirably, however, the coupling pin or pins are provided on the skiing boot and the pivoted locking arm or arms are provided on the hood because in this case the weight of the skiing boot can be minimized and the skiing boot is similar in appearance to a conventional skiing boot.

In a development of the main features of the invention, the disc may constitute a female detent member and may have a flat or concave portion, which is engaged on the outside or inside by a male detent member which is biased by at least one spring. The male detent member may consist of the free end of one arm of a bell-crank lever, which is mounted in the skiing boot and at its other arm is engaged by the spring.

In the embodiment just described, the male detent member can no longer be damaged when the person wearing the skiing boot is walking if the male detent member consists of a lever, which is mounted on a horizontal transverse pivot in a hood for the disc, which hood extends into the recess in the sole of the boot, and the spring acts on the male detent member by a bell-crank lever which is mounted in the skiing boot on a horizontal transverse pivot, and the disc is formed with a flat abutment surface, which extends transversely to the longitudinal direction of the ski and is at an acute angle to the surface of the ski.

In all embodiments described hereinbefore, the toe portion of the sole must be held against an undesired upward movement, e.g., by an arrangement described hereinbefore.

According to a further feature of the present invention, these means to prevent an upward movement may be provided in those embodiments which comprise a hood in a simple manner in that a soleplate which underlies the metastarsal portion of the skiing boot is firmly connected to the hood and at its free end is provided with down-holding means, which permit of a low-friction pivotal movement on the surface of the ski, and with barbs, which on the sides of the sole of the boot extend upwardly and are adapted to cooperate with lateral retaining pins with which the sole of the boot is provided.

Several embodiments of the safety ski binding system according to the invention will now be described more fully and by way of example with reference to the accompanying drawings, in which FIG. 1 is a top plan view showing the safety ski binding system according to the invention, FIG. 2 is a side elevation showing the system of FIG. 1, FIG. 3 is a transverse sectional view taken on line III—III in FIG. 2.

Figure 1:
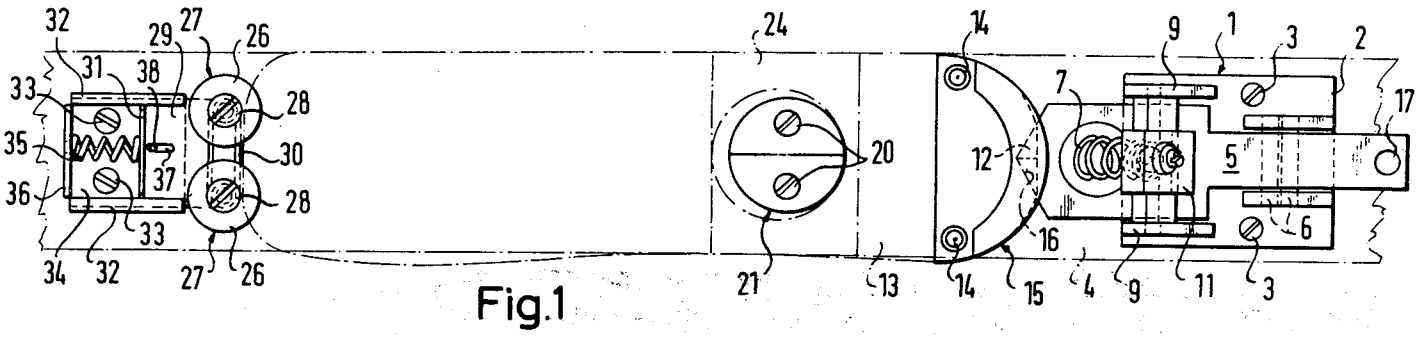

The safety ski binding system which is shown comprises a releasing device in the form of a heel-holding device 1, which is carried by a baseplate 2, which by means of screws 3 is secured to a ski 4. The heel-holding device consists substantially of a pivoted locking arm 5, which is mounted to be displaceable and pivotally movable against the force of a helical compression spring between two fixed, round-section cross-bars 6 (see particularly FIG. 2). The cross-bars 6 are held in two lateral lugs which are fixed to the baseplate. The range of movement of the locking arm 5 is limited by two cam slots 8 (see FIG. 2), which are formed in respective side walls 9, which extend vertically upwardly from the baseplate 2. The locking arm 5 carries two horizontal pins 10, each of which extends into one of the slots 8. The helical compression spring is upwardly inclined and at its lower end bears on the locking member 5. The upper end of the spring bears on an adjustable spring abutment 11, which is pivoted between the side walls 9. Being known per se, that spring abutment 11 is not described more fully.

The foward end 12 of the pivoted locking arm 5 is pointed toward the center and upwardly and when the skiing boot has been inserted said end extends into a recess 16 in a fitting 15, which is secured by screws 14 to the heel of the skiing boot 13, which is indicated in dash-dot lines.

A cylindrical disc 21 is secured to the ski 4 below the ankle portion by means of two screws 20 and is at least approximately coaxial to the tibia. The disc has a wedge-shaped top portion (see particularly FIGS. 2 and 3). The wedge surfaces 22 extend in the longitudinal direction of the ski. When the skiing boot 13 is placed on the ski 4, the disc 21 extends into a vertical recess 23 in the sole of the boot, as is clearly apparent from FIGS. 2 and 3. This disc 21 serves as an abutment for the skiing boot 13 and takes up the longitudinal thrust, which is exerted by the spring-biased pivoted locking arm 5 of the heel-holding device 1. The disc also defines an exact axis for the rotation of the skiing boot on the ski. The sole of the boot is formed with a horizontal transverse hole 24, and the vertical recess 23 opens into said hole. Over the recess 23, a wedge-shaped nose 25 is provided on the upper wall portion of the hole 24 and extends over the recess 23 and has an apex extending in the longitudinal direction of the boot.

The toe portion of the sole of the boot is engaged on top by the caps 26 of two juxtaposed mushroom-shaped rollers 27. The undersides of the caps are conical. Each roller is freely rotatably mounted on an axle 28, which extends vertically upwardly from a carrier plate 29. An endless belt 30 of rubber or plastics material extends around the shanks of the rollers 27 and transmits the rotation of one roller to the other. At its forward end, which faces the tip of the ski, the carrier plate 29 is provided with an upwardly angled lug 31. The carrier plate 29 is laterally guided in the longitudinal direction in slideways 32 provided on a baseplate 34, which is secured to the ski 4 by screws 33. The lug 31 serves as a spring abutment for a helical compression spring 35, which at its other end bears on another lug 36 which is angled upwardly from the baseplate 34. The carrier plate 29 also comprises a slot 37 (see FIG. 1), which receives a pin 38 that is fixed to the baseplate so that the longitudinal displacement of the plate 29 relative to the heel-holding device is limited.

The manipulation of the binding system is very simple. To apply a ski, the skier holds the skiing boot 13 transversely to the ski 4 and then places the boot onto the ski so that the disc 21 extends into the vertical recess 23 in the sole of the boot. When the recess 23 is filled with snow, the wedge surfaces of the disc 21 and the nose 25 in the horizontal transverse hole 24 force the snow laterally out of the hole 24. The foot is then turned so that the pivoted locking arm 5 of the heel-holding member 1 is forced back until the locking arm snaps into the detent recess 16 formed in the boot fitting 15. The locking arm 5 is forced back as a result of the sliding engagement of inclined side faces of the locking arm with run-up surfaces on the boot fitting 15. Any snow which may adhere to the underside of the sole of the boot is stripped off in this operation. The mushroom-shaped rollers 27, which normally hold down the toe portion of the skiing boot, are forced slightly forwardly during the pivotal movement of the skiing boot so that the rollers 27 and the belt 30 roll on the sole of the boot and the carrier plate 29 is displaced in the guide 32 of the baseplate 34. A turning of the ski 4 during the pivotal movement of the skiing boot may be prevented in that the ski poles are inserted on opposite sides of the ski before and behind the binding.

When the skiing boot 13 is then acted upon by a force which is transverse to the longitudinal direction of the ski and which overcomes the initial stress of the spring 7, the skiing boot will rotate about the disc 21 and the locking arm 5 will be displaced rearwardly because the detent mechanism is correspondingly designed. Upon a decrease of the force, the locking arm 5 will return into the detent recess 16 in the boot fitting 15 so that the skiing boot is turned back to its initial position. In response to vertically upwardly directed forces acting on the rear part of the skiing boot the locking arm may perform a slight upward pivotal movement between the cross-bars 6 in addition to its longitudinal movement so that the elastic range of the heel-holding device is increased. This elastic range is provided for by the detent mechanism. When the set force required for a release of the heel-holding device 1 is not reached, the spring 7 will force the skiing boot 13 back to its initial position by means of the locking arm 5.

If the end 12 of the locking arm 5 is acted upon by a force which is not a mere shock and which exceeds the set force required for a release of the binding, that end 12 will be forced out of the detent recess 16 of the shoe fitting 15 so that the heel of the skiing boot is released and the skiing boot separates from the ski. During a dangerous rearward fall of the skier, the toe portion of the skiing boot pushes forwardly the forward holding-down rollers 27 and their carrier plate 29 against the bias of the spring 35 while the top edge of the sole of the boot slides upwardly on the conical sides of the caps 26 of the mushroom-shaped holding-down rollers until the toe portion of the skiing boot is released and the boot is also separated from the ski. It is thus seen that the skiing boot will be released in response to an excessive force in any direction.

To enable an arbitrary unlocking of the binding, the locking arm 5 may be rearwardly extended and provided with a bore 17. When the tip of the ski pole is inserted into said bore 17 and a vertical pressure is applied to the ski pole, the heel of the boot may be lifted without a large effort so that the forward end of the locking arm swings upwardly and then disengages the boot fitting so that the heel is unlocked.

The device which is provided in front of the skiing boot and serves to hold down the toe portion of the sole may be eliminated if a second holding-down means for the skiing boot is provided besides the heel-holding device, e.g., in that the disc 21 is undercut and said undercut portion is engaged from below by an extension which protrudes into the recess in the skiing boot.

Figure 2:
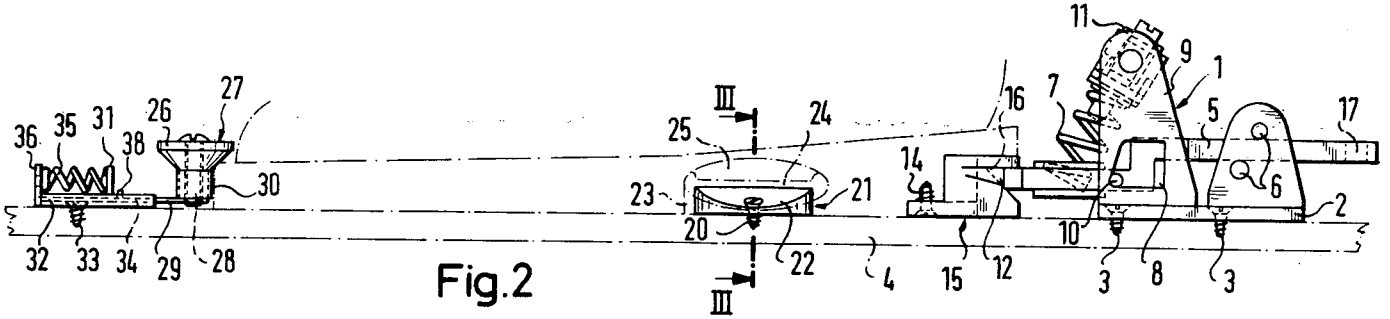
Figure 3:
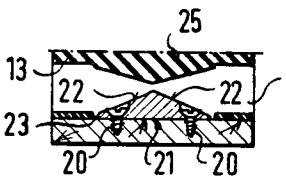

The embodiments of the ski binding system which will be described hereinafter and are shown in FIGS. 4 to 18, are similar to the embodiment of FIGS. 1 to 3 in that the functional parts comprise a heel-holding device and an abutment mounted on the ski as well as the sole of the skiing boot. The heel-holding device normally forces the sole of the boot against the abutment and in response to a vertically and/or horizontally directed overload releases the skiing boot. The abutment consists of a disc, which is secured to the ski to be at least approximately coaxial to the tibia and when the skiing boot is applied extends into a corresponding recess in the soles of the boot. According to the present development of the invention, the disc constitutes a member of a detent mechanism of the heel-holding device.

Figure 4:
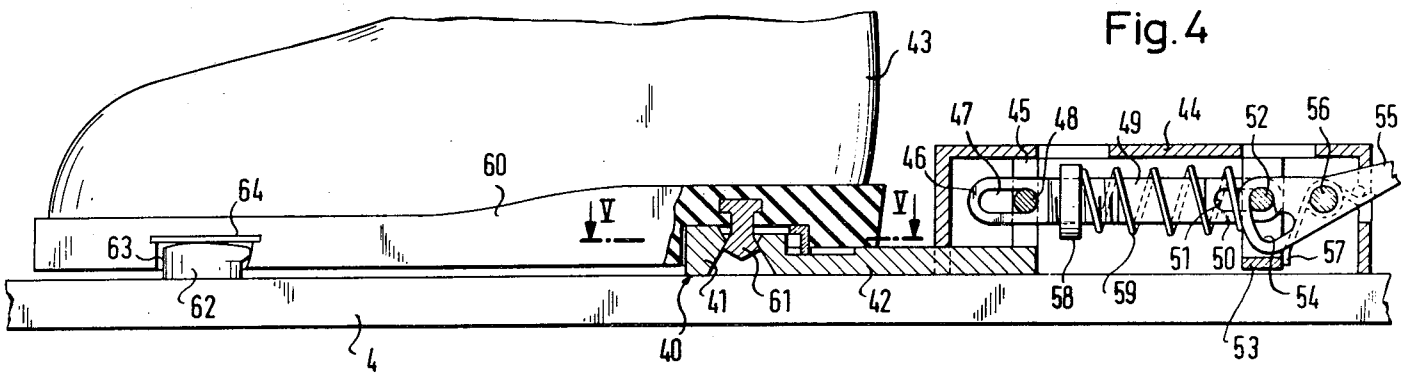
FIG. 4 is a side elevation showing a second embodiment of the safety ski binding system partially cut away for a better showing of details.
Figure 6:
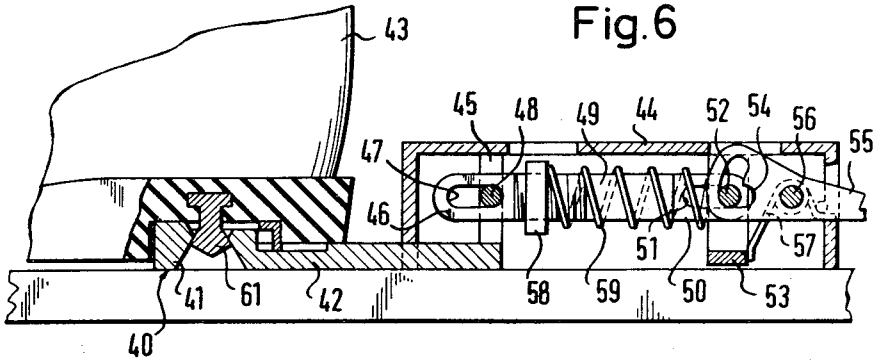
FIG. 6 is a fragmentary elevation similar to FIG. 4 but shows the system when it has been arbitrarily unlocked.
Figure 5:
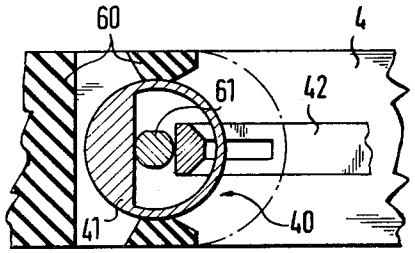
FIG. 5 is a fragmentary sectional view taken on line V—V in FIG. 4 and showing part of the system.

In the embodiment shown in FIGS. 4 to 6, the ski carries a disc 40, which consists of two parts, namely, a clamp abutment 41 and a clamp jaw 42. The clamp jaw extends from adjacent to the skiing boot 43 outwardly toward the rear end of the ski into a housing 44, which is mounted on the ski. The clamp jaw 42 is formed with an upwardly angled guide arm 45, which has a central vertical slot for receiving a locking lug 46, which is formed with a slot 47, through the wheel a locking pin 48 extends, which is mounted in the guide arm 45.

The locking lug 46 is provided at one end of a pin 49, the other end of which is provided with a corresponding locking lug 50, which is formed with a slot 51. A locking pin 52 is mounted in legs of a U-shaped slide member 53 and extends through the slot 51 and through a guide groove 54, which is formed in a locking lever 55, which is mounted in the housing 44 on a pivot 56 for pivotal movement against the bias of a U-shaped spring 57. The locking lever is a two-armed lever. That arm of the lever which is not formed with the guide groove 54 extends rearwardly out of the housing 44 and serves as an unlocking member.

At its end carrying the locking lug 46, the pin 49 is provided with screw threads in threaded engagement with a nut 58, which forms an adjustable abutment for a helical compression spring 59, which at its other end bears on the slide member 53.

At its rear end, the sole 60 of the skiing boot 43 is formed with recesses, which serve to receive the disc 40 and to enable a pivotal movement of the skiing boot on the ski (see FIG. 5). A detent pin 61 is secured to the sole 60 and with its free end portion depends into the recess serving to receive the disc 40. The pin 61 and said recess form the detent mechanism of the heel-holding device. The detent pin has two inclined surfaces, which in locked position are engaged each from above by respective inclined surfaces of the clamp abutment 41 and of the clamp jaw 42. This condition is shown in FIG. 4. The detent pin can snap into position because it has a pointed free end portion and the clamp abutment 41 and the clamp jaw 42 are respectively provided with upwardly diverging, inclined surfaces.

During a lifting of the rear end of the skiing boot 43, the detent pin 61 displaces the clamp jaw 42 toward the rear end of the ski against the resistance presented by the helical compression spring 59, which is more or less prestressed so that it holds the right-hand end of the slot 47 in the drawing in engagement with the locking pin 48. At least the functional portion of the detent pin 61 is out-of-round (see the transverse sectional view in FIG. 5) so that there is in the normal, locked condition a linear contact between the clamp abutment 41 and the clamp jaw 42, on the one hand, and the detent pin 61, on the other hand. Just as the lifting of the rear end of the skiing boot, a pivotal movement of the skiing boot will result in a displacement of the clamp jaw 42 toward the rear end of the ski against the force of the helical compression spring 49.

The toe portion of the sole is held down by a slide member 62, which is mounted on the ski 4 and is curved (not shown) in accordance with the radius of the pivotal movement of the boot. The sole 60 of the boot is formed with a recess 63, which serves to receive the slide member and has a corresponding curvature. A plate 64 is provided at the top of the recess 63 and the skiing boot bears on the slide member 62 through the intermediary of said plate. To minimize the friction between parts 62 and 64, they are made in known manner from suitable materials having a low coefficient of friction. The slide member 62 is undercut on its side facing the rear end of the ski. The recess 63 of the sole of the boot has such a cross-sectional shape that the sole is formed with a nose, which engages said undercut portion so that the toe portion of the boot cannot be readily lifted from the ski. In response to a sufficiently strong force acting upwardly on the toe portion of the boot, the latter will be displaced toward the rear end of the ski by means of the detent pin 61 and the clamp jaw 42 against the bias of the helical compression spring 59.

The U-shaped spring 57 normally holds the locking lever 55 in the position shown in FIG. 4. In this position of the bell-crank lever, the locking pin 52 is disposed in the upwardly directed arm of the angled guide groove 54 and the slide member 53 which forms an abutment for the helical compression spring 59 is locked in the housing 44. When it is desired to lift the skiing boot 43 from the ski 4, the detent mechanism can be unlocked arbitrarily in that the locking lever 55 can be pivotally moved against the bias of the U-shaped spring 57 to the position shown in FIG. 6, e.g., by means of the tip of a ski pole. In this position of the locking lever 55, the locking pin 52 can enter the other arm of the guide groove 54, which other arm now extends horizontally, so that the slide member 53 can be moved a corresponding distance toward the rear end of the ski. For that movement it is sufficient to overcome the relatively small bias of the U-shaped spring 57; this bias is small compared to the force of the helical compression spring 59. When the rear end of the skiing boot is now raised, the detent pin 61 can displace the clamp jaw 42 without need to overcome the force of the helical compression spring 59. The U-shaped spring 57 then returns the clamp jaw 42 to its normal position. When the locking lever 55 has been released, the U-shaped spring 57 returns also this lever to its normal position shown in FIG. 4.

Hence, the detent mechanism resists a rotation of the skiing boot to the right and left and resists a lifting of the skiing boot from the ski in response to a force which acts on the toe portion or rear end portion of the skiing boot.

In the embodiment shown in FIGS. 7–10, the safety ski binding system has exactly the same mode of operation as the embodiment shown in FIGS. 4–6. For this reason, only the heel portion of the skiing boot 66 and the adjacent parts of the binding are shown. The ski 4 carries again a two-part disc 69, which comprises a clamp abutment 67 and a clamp jaw 68. As in the embodiment described last, the clamp jaw extends from adjacent to the skiing boot rearwardly toward the rear end of the ski into a housing, not shown, which is mounted on the ski. The housing and the parts accommodated therein may be arranged and cooperate like those shown in FIG. 4, except for the means for an arbitrary unlocking of the detent mechanism. These means may be omitted in this case, as will become apparent from the further description.

The toe portion of the skiing boot 66 is held down by the same means as in the embodiment shown in FIG. 4. For this reason, these means are not shown.

A difference from the embodiment shown in FIGS. 4–6 resides in that a detent pin 70 is provided on a hood 72 for the disc 69 rather than on the sole 71 of the boot. The hood extends into a recess in the sole of the boot and is firmly connected to the latter by locking means which are only arbitrarily releasable. These locking means comprise a locking bar 73, which extends transversely through the skiing boot and protrudes to some extent on both sides, and two pivot pins 74, 75, which are coaxial to each other and extend transversely to the longitudinal direction of the ski and are secured to the hood 72. A hook member 76 is secured to each pivot pin and has an angled free end portion which engages the top of the locking bar 73 when the skiing boot 66 is applied. A locking lever 77 is also pivotally mounted on each pivot pin 74, 75. The two locking levers are two-armed and those arms thereof which are not provided with the locking noses are combined to form a U-shaped unlocking member 78 (see FIG. 10). Each locking lever 77 is biased by a U-shaped spring 79, which tends to hold the locking lever in its locking position, shown in FIG. 9. In this position the locking noses of the locking levers extend from the other side over and engage the top of the locking bar 73. As has been mentioned above, these locking means eliminate the need for means which facilitate an arbitrary displacement of the clamp jaw 68 when it is desired to lift the skiing boot from the ski.

The unlocking member 78 may be operated to unlock the skiing boot 66 so that the same can be lifted from the ski. In that case, the hood 72 is retained on the ski 4 because the detent pin 70 is locked in the disc 69. During a safety release, on the other hand, the hood 72 is released from the ski 4 together with the skiing boot 66 because the locking means is in locking position. After a safety release, the detent pin 17 will be located immediately when the skiing boot is placed on the ski.

Figure 9:
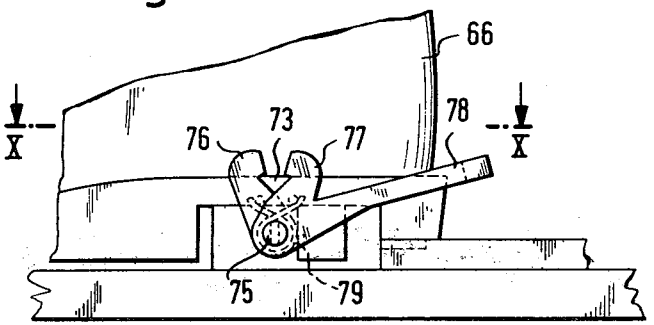
FIG. 9 is a side elevation of the system of FIG. 7.
Figure 10:
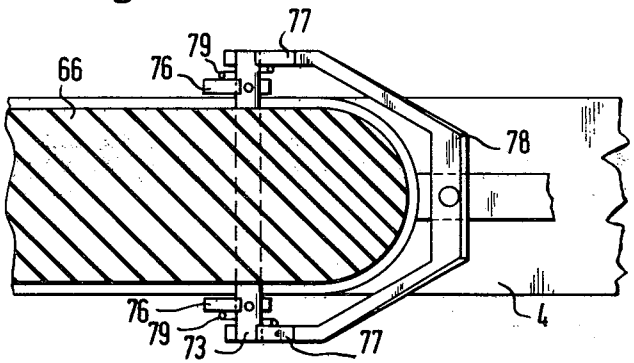
FIG. 10 is a sectional view taken on line X—X in FIG. 9.
Figure 7:
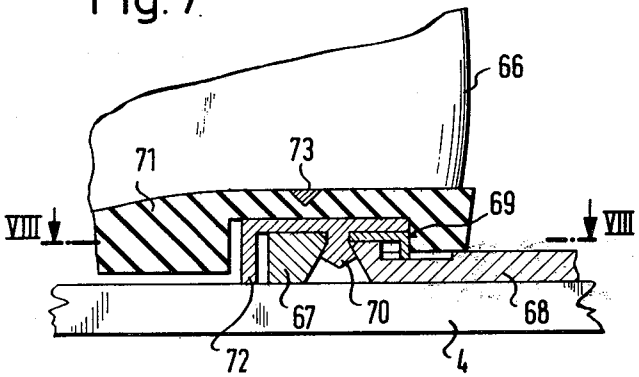
FIG. 7 is a sectional view which is similar to FIG. 6 but shows a third embodiment of the safety ski binding system in a locked state.
Figure 8:
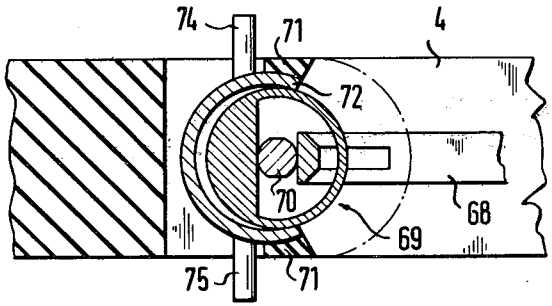
FIG. 8 is a sectional view taken on line VIII—VIII in FIG. 7.

As is apparent from FIGS. 7 and 9, the locking bar 73 is tapered downwardly so that the skiing boot 66 can be locked on the hood 72 without need for an actuation of the unlocking member 78.

Compared to the embodiment described with reference to FIGS. 4–6, the embodiment just described has the advantage that the entire detent mechanism is disposed under the hood 72 so that the functional surfaces of the detent mechanism are fully protected.

FIGS. 11 to 14 show a fourth embodiment of the safety ski binding system according to the invention. This embodiment has the same mode of operation as the embodiments described hereinbefore. Only the heel portion of the skiing boot 80 and the adjacent binding parts are shown. The toe portion of the skiing boot is held down, e.g., by the means which are shown in FIG. 4 and which are not shown here.

Figure 13:
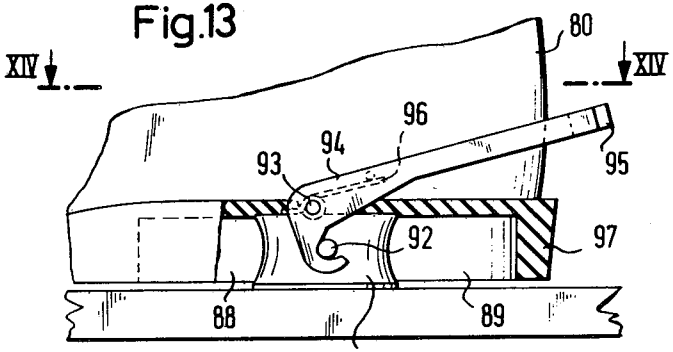
FIGS. 11–14 are views which are similar to FIGS. 7–10 and show a fourth embodiment of the safety ski binding system.
Figure 11:
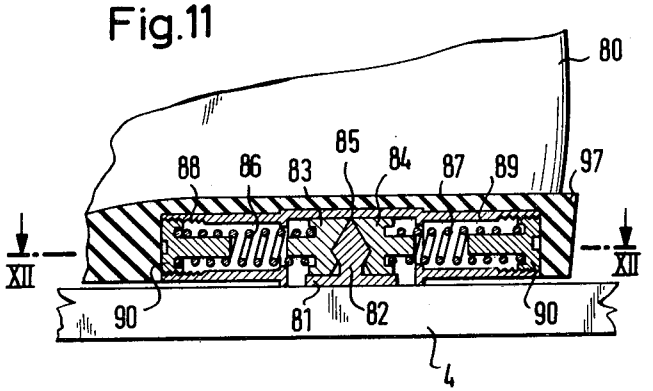
Figure 14:
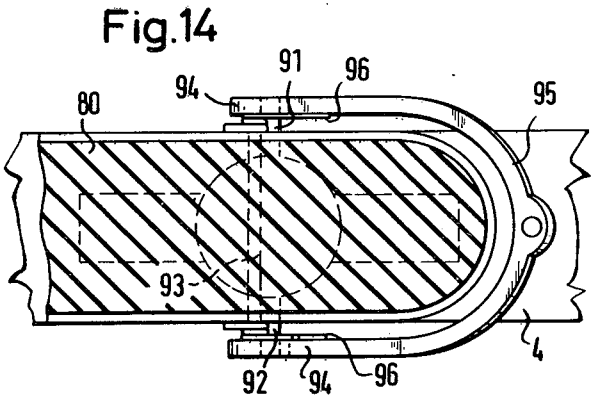
Figure 12:
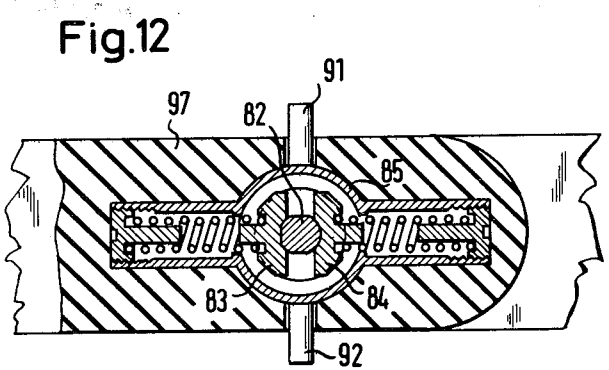

The present embodiment differs from the two embodiments described last hereinbefore in that the disc 81 is integral and carries an upstanding detent pin 32. In the illustrated position for use, the detent pin is locked by two clamp members 83, 84, which are accommodated in a hood 85 and biased by respective helical compression springs 86 and 87. The springs are accommodated in sleeves 88, 89, which are integral with the hood 85. The free end portions of the sleeves have internal screw threads, into which respective screw have internal screw threads, into which respective screw plugs 90 are threaded, each of which constitutes an adjustable spring abutment. Two pins 91, 92 extend radially outwardly from the hood 85 at right angles to the sleeves 88, 89, which normally extend in the longitudinal direction of the ski. These pins form parts of means for locking the skiing boot 80, which on a horizontal transverse pivot 93 carries two two-armed locking levers 94. Those arms of the levers 94 which are not provided with the locking noses are combined in a U-shaped unlocking member 95 (see FIG. 14). Each locking lever is under the influence of a U-shaped spring 96, which tends to hold it in its locking position, which is shown in FIG. 13 and in which the locking noses of the locking levers interlock with the pins 91, 92. The sole 97 of the boot has a suitable recess for receiving the hood 85 with the sleeves 88, 89 and the pins 91, 92. In this embodiment too, the unlocking member 95 can be actuated to unlock the skiing boot 80 so that the same can be lifted from the ski 4. As in the embodiment shown in FIGS. 7 to 10, the hood is then retained on the ski because the detent pin 82 is locked by the clamp members 83, 84. During a safety release, the hood 85 separates from the ski 4 together with the skiing boot 80 because the locking means ensure a connection between the boot and hood. After a safety release, the detent pin 82 can again be locked by the clamp members 83, 84 in that the skiing boot is placed onto the ski.

In this embodiment the unlocking member 95 forming a part of the locking levers 94 is inseparably connected to the skiing boot 80 by the transverse pivot 93. To enable a placing of the skiing boot onto the hood without need for an actuation of the unlocking member 95 and to ensure that the boot will be automatically locked, the free end portion of each locking lever forms a run-up ramp below the respective locking nose. In this embodiment too, the entire detent mechanism is disposed under the hood 85 so that the functional surfaces are perfectly protected.

Figure 15:
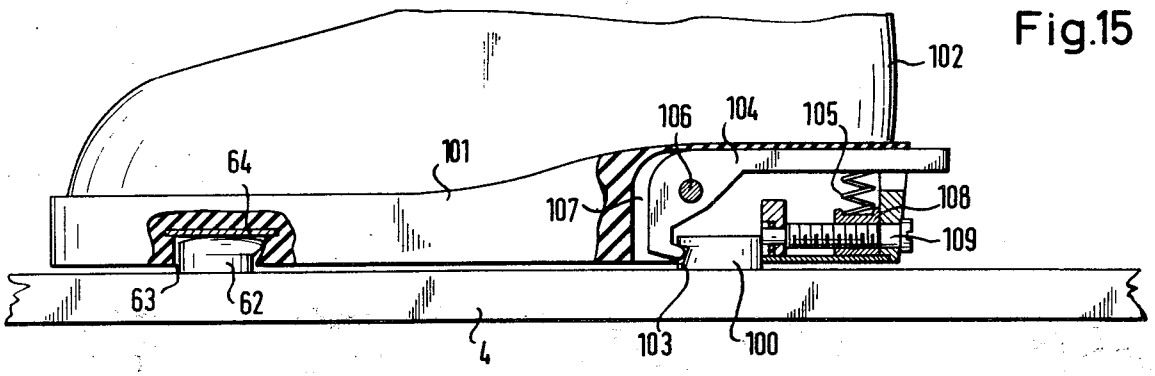
FIG. 15 is a side elevation showing a fifth embodiment of a ski binding system partly cut away.
Figure 16:
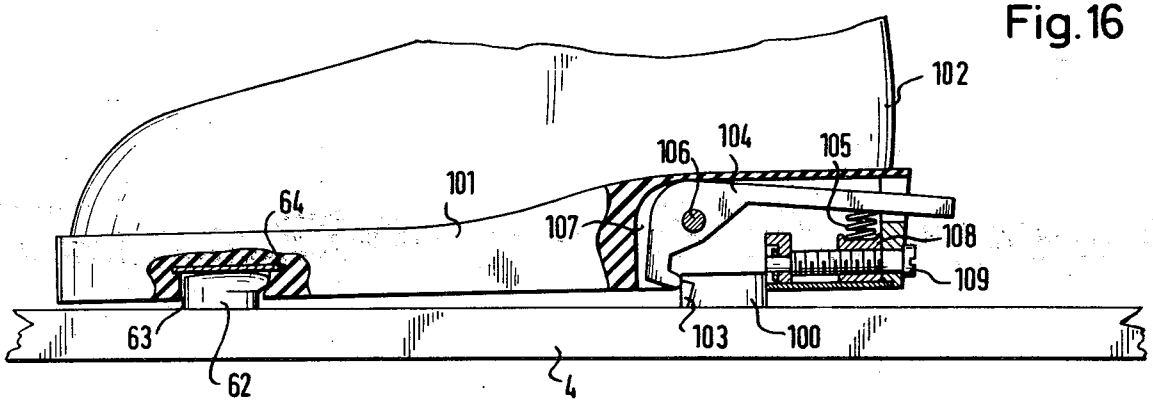
FIG. 16 is a side elevation similar to that of FIG. 15 and shows the system in a different instantaneous condition.

FIGS. 15 and 16 show a different embodiment of the safety ski binding system according to the invention. A disc 100 is secured by suitable means, not shown. As in the second embodiment shown in FIG. 4, the toe portion of the sole 101 of the skiing boot 102 is held down on the ski by a slide member 62, which extends into a recess 63 formed in the sole of the boot. A plate 64 is again provided at the top of said recess.

In this embodiment the disc 100 serves as a female detent member and comprises a concave portion 103, which normally receives a male detent member consisting of the free end portion of one arm of a bell-crank lever 104. The other arm of said lever is biased by a helical compression spring 105. The bell-crank lever is pivoted on a pivot 106 in a recess 107 of the sole 101. The spring 105 bears on an abutment, which consists of a traveling nut 108 threaded on an adjusting screw 109, which is rotatably and axially non-displaceably mounted in the sole of the boot. The screw can be rotated to adjust the traveling nut and the helical compression spring to vary the force required for a release. The free end of the arm of the bell-crank lever 104 extends rearwardly out of the heel 101 of the boot and forms an unlocking member, which can be actuated, e.g., by a ski pole, when it is desired to lift the skiing boot 102 from the ski 4.

The concave portion 103 of the disc 100, which portion forms a female detent member, may be designed so that the detent mechanism serves to lock the skiing boot against a movement in a plane which is parallel to the ski and in an upward direction. In response to a force which acts in any direction and is dangerous to the skier's leg, the detent mechanism is released and the skiing boot 102 can separate from the ski. The male detent member formed by the free end portion of one arm of the bell-crank lever 104 and the disc 100 forming a female detent member are designed so that the parts are locked automatically when the skiing boot 102 is placed onto the ski 4 and without need for an actuation of the unlocking member. FIG. 15 shows the boot in its normal operating condition on the ski. FIG. 16 shows an instantaneous condition, which is obtained, e.g., immediately during a release in response to a forward fall or immediately before the male detent member snaps in as the skiing boot is placed onto the ski.

Figure 17:
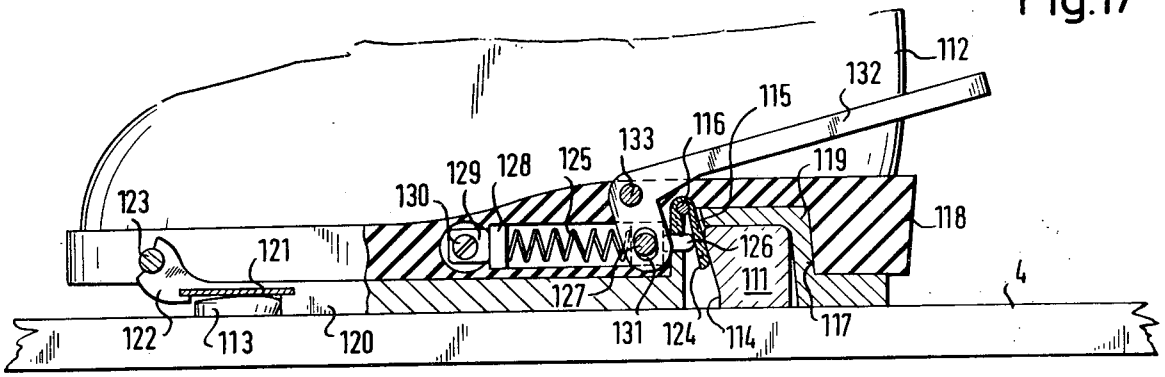
FIG. 17 is a side elevation showing a further embodiment of the safety ski binding system partly cut away.
Figure 18:
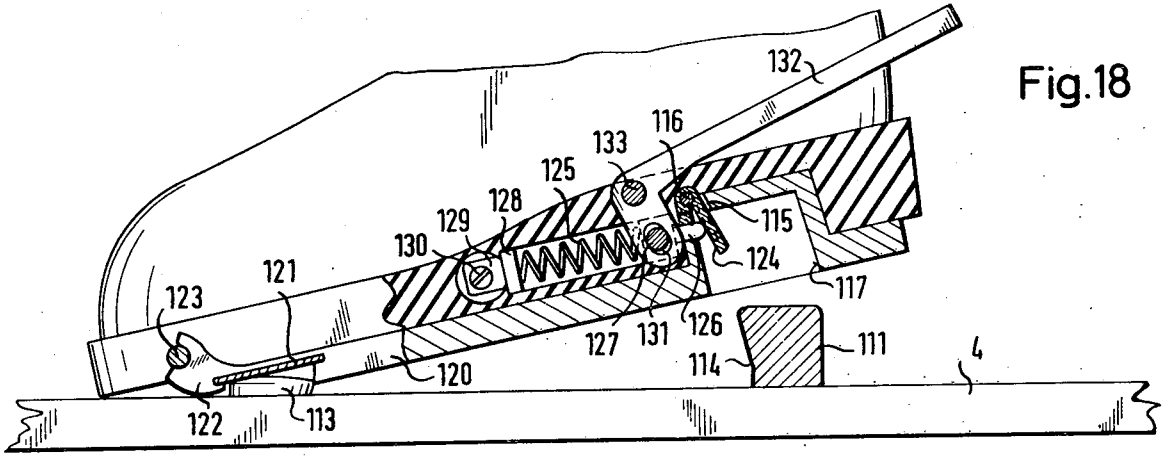
FIG. 18 is a view which is similar to FIG. 17 and shows the system in a different instantaneous condition.

FIGS. 17 and 18 show a further embodiment of the safety ski binding system according to the invention. As in the embodiment described with reference to FIGS. 15 and 16, a disc 111 is secured to the ski 4 and is thicker than the disc 100. A slide member 113 is provided on the ski adjacent to the toe portion of the skiing boot 112. The disc 111 has a flat bearing surface 114, which extends transversely to the longitudinal direction of the ski and extends at an acute angle to the surface of the ski. The female detent member is again formed by the disc. The male detent member consists of a lever 115, which is mounted on a horizontal transverse pivot 116 in a hood 119 for the disc 111. The hood 119 extends into a recess 117 in the sole 118 of the boot. A soleplate 120 is secured to the hood and extends below the metatarsal portion of the skiing boot 112. The soleplate 120 is provided at its free end with a bearing plate 121 so that the soleplate is supported on and can be pivotally moved with low friction on the slide member 113. The soleplate is also provided with barbs 122, which extend upwardly on the sides of the sole 118 of the boot and are intended to cooperate with lateral locking pins 123 on the sole of the boot. As in the second and following embodiments, the slide member 113 is curved in accordance with the radius of the pivotal movement of the soleplate 120. The slide member is undercut on the side facing the rear end of the ski to provide a free space, which normally receives a noselike extension of the soleplate so that the forward portion of the soleplate cannot be readily lifted from the ski.

The lever 115 is under the influence of a weak U-shaped spring 124, which serves only to hold the lever in its locking position. The force which is to be overcome for a release is substantially exerted by a helical compression spring 125, which is accommodated in a recess in the sole 118 of the boot and which by means of a push rod 126 acts on the lever 115. For this purpose, the push rod has a tapered portion, which extends through a corresponding bore in the hood 119. The spring 125 bears on an inner abutment 128, which engages a cam disc 129, which is, e.g., quadrangular.

This cam disc is secured on a horizontal transverse shaft 130 in the sole 118 of the boot. By a rotation of the shaft 130, four different positions for the abutment and four different forces required for a safety release can be adjusted.

The push rod 126 has at least one lateral pin 127, which extends into a slot 131 of an arm of a bell-crank lever 132, which is pivoted on a horizontal transverse pivot 133 in the sole of the skiing boot. The other arm of the bell-crank lever extends rearwardly beyond the end of the skiing boot 112 and serves as an unlocking member.

FIG. 17 shows the skiing boot 112 and the soleplate 120 in normal position on the ski 4. FIG. 18 shows the skiing boot and the soleplate in an instantaneous condition during a forward fall in a phase in which the detent mechanism has already been released so that the soleplate has been disconnected from the ski. When the binding should be restored to its normal position after a safety release, the forward portion of the soleplate 120, which is secured to the skiing boot, will be placed onto the slide member 113 mounted on the ski in such a manner that the hood 119 overlies the disc 111, whereafter the boot is depressed. The parts 111 and 115 are designed so that they will automatically interlock as a result of this operation. The skiing boot 112 can be only arbitrarily detached from the soleplate. For this purpose, the bell-crank lever 132 is pivotally moved until the tapered portion of the push rod 126 disengages the hood 119. Then the rear portion of the skiing boot can be lifted and the pins 123 at the toe portion of the skiing boot can be disengaged from the barbs 122 provided on the soleplate 120. The skiing boot is locked to the soleplate in the reverse order.

As in the embodiment shown in FIGS. 15 and 16, the detent mechanism serves to lock the skiing boot — in this case by means of the soleplate — against a movement in a plane which is parallel to the ski and in an upward direction. The detent mechanism will be released when the skiing boot is subjected to a force which is dangerous to the skier's leg, whether this force is a twisting force, a tensile force or a force resulting from both components.

To prevent the ski from unintendedly sliding or flying away after a safety release, a retaining belt or cable, e.g., is required, by which the skier remains connected to the ski. In all those embodiments described hereinbefore which comprise a hood, the need for a special, complicated application of the retaining belt or cable can be eliminated in a simple manner in that this belt or cable is provided between the hood and the ski or a part secured to the ski. Because various types of retaining means are known and numerous embodiments are conceivable, the use of such means within the scope of the present invention has not been illustrated nor fully described.

What is claimed is:

1. A safety ski binding system comprising a disc-shaped abutment mounted on a ski in a position adapted to be approximately coaxial to the tibia of the skier, a skiing boot having a recess in a sole thereof, a hood including at least one resilient clamp member, said hood and abutment being adapted to extend into said recess in the sole of said skiing boot, said abutment carrying an upstanding detent pin adapted to interlock with said at least one resilient clamp member, and locking means for securing said hood to said skiing boot so that said hood can be only arbitrarily unlocked, said hood adapted to cooperate with the sole of said skiing boot to force said sole against said abutment and to release said boot in response to a predetermined overload force.

2. A safety ski binding system according to claim 1, wherein said locking means includes at least one coupling pin and a lever, said lever including at least one pivoted locking arm and at least one arm which constitutes an unlocking member and which is pivotally movable against a spring bias from its locking position to its unlocked position.

3. A safety ski binding system according to claim 2, wherein the at least one coupling pin is provided on the hood and the at least one pivoted locking arm is provided on the skiing boot.

4. A safety ski binding system according to claim 2, wherein the at least one coupling pin is provided on the skiing boot and the at least one pivoted locking arm is provided on the hood.

* * * * *